United States Patent [19]

Furukawa et al.

[11] Patent Number: 4,472,996

[45] Date of Patent: Sep. 25, 1984

[54] TOYS UTILIZING FLUID PROPULSION DEVICE

[75] Inventors: Masami Furukawa; Kenzo Akiyama, both of Tokyo, Japan

[73] Assignee: Tomy Kogyo Company, Inc., Japan

[21] Appl. No.: 370,341

[22] Filed: Apr. 21, 1982

[30] Foreign Application Priority Data

Apr. 24, 1981 [JP] Japan ..... 56-61451

[51] Int. Cl.[3] ..... F01L 31/02

[52] U.S. Cl. ..... 91/347; 91/453; 92/132

[58] Field of Search ..... 91/347, 453, 132

[56] References Cited

U.S. PATENT DOCUMENTS

| | | | |
|---|---|---|---|
| 1,067,613 | 7/1913 | Lane | 91/347 |
| 1,953,262 | 4/1934 | Police | 91/347 |
| 2,631,573 | 3/1953 | Levitt et al. | 91/347 |
| 2,698,608 | 1/1955 | Milner et al. | 91/347 |
| 2,698,710 | 1/1955 | Pedroia | 91/347 |
| 2,841,119 | 7/1958 | Segerstad | 91/347 |

FOREIGN PATENT DOCUMENTS

| | | | |
|---|---|---|---|
| 515687 | 12/1939 | United Kingdom | 91/347 |

*Primary Examiner*—Paul E. Maslousky

*Attorney, Agent, or Firm*—K. H. Boswell; Edward D. O'Brian

[57] ABSTRACT

A series of toys having unique motions are activated by a fluid propelled propulsion device. The propulsion device includes a housing with a cylinder located thereon. A pressurized fluid reservoir connects to the cylinder via a valve. The valve has provisions for introducing pressurized fluid into the cylinder and exhausting pressurized fluid out of the cylinder. A piston is located in the cylinder and in response to introduction of pressurized fluid into the cylinder, moves in a power stroke. This is followed by an exhaust stroke wherein the piston moves in the opposite direction. A piston output member is associated with the piston and extends out of the cylinder. The piston output member moves linearly in response to movement of the piston in its power and exhaust strokes. A connecting mechanism connects the piston output member and the valve. The connecting mechanism includes a first movable member and a second movable member and a biasing member. The first movable member is operatively associated with the valve and controls the position of the valve for charging and exhausting the cylinder. The biasing member interacts with the first member for controlling the valve. The second movable member moves the first movable member to initiate at least one of the charging or exhaust operations of the valve in response to movement of the piston. The second movable member can move the first movable member to initiate the other of the charging or exhaust functions of the valve in response to movement of the piston in the opposite direction, or an independent movement can be utilized to initiate this operation.

12 Claims, 23 Drawing Figures

FIG. 1.
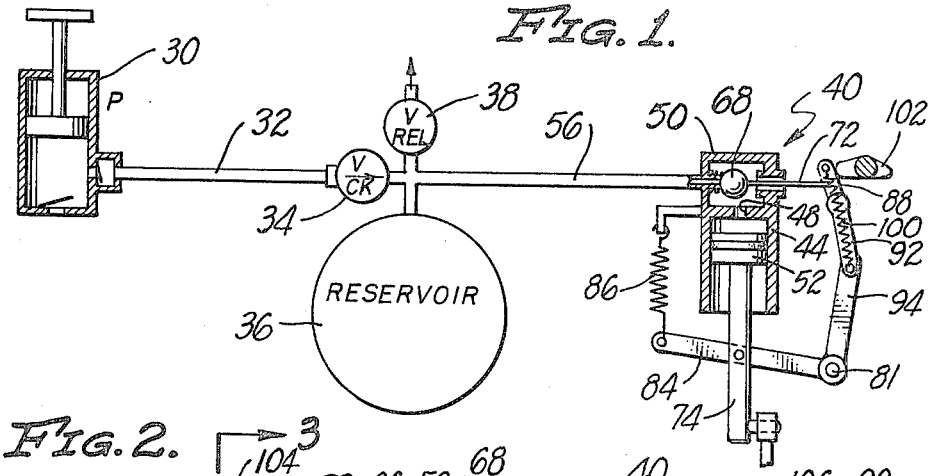
FIG. 2.
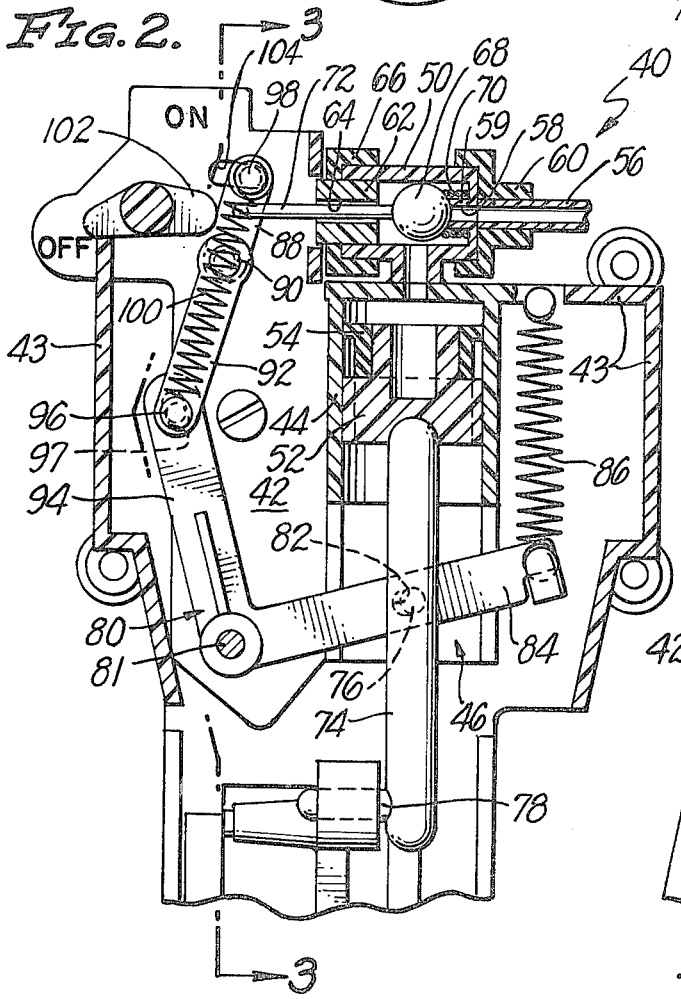
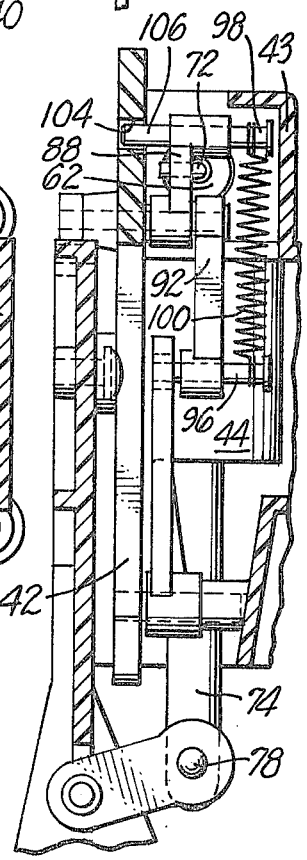
FIG. 3.

7
108
146
152
72
50
68
172
56
144
148
156
110
124
142
150
122
139
140
112
136
138
154
116
130
134
126
128
132
158
160
164
114
168
162
120
166
118
170

FIG. 11.
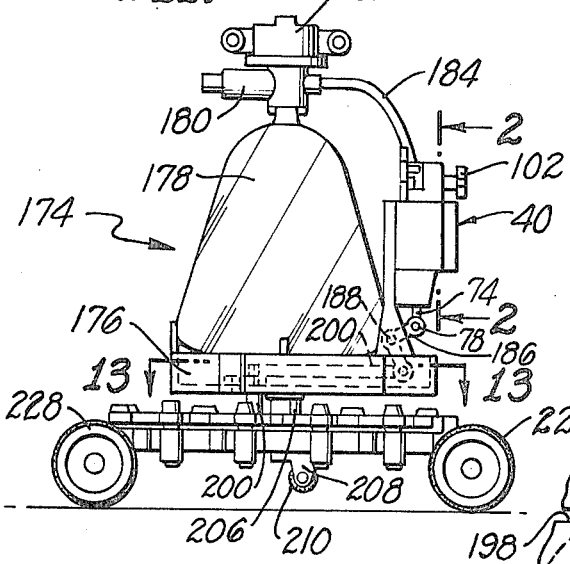
FIG. 14.
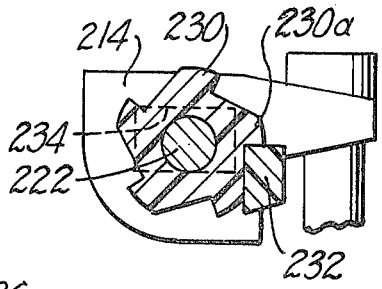
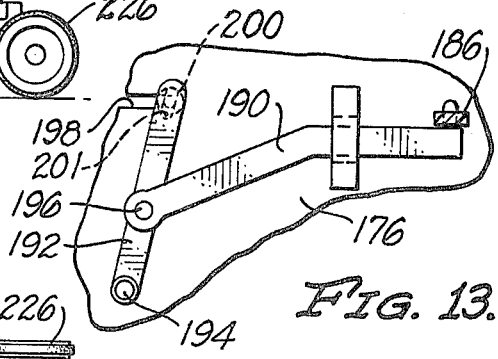
FIG. 13.
FIG. 12.
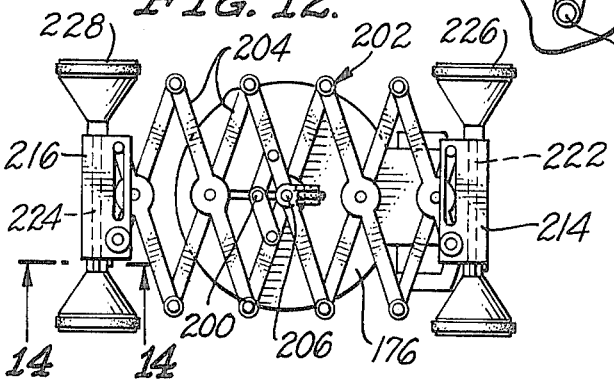
FIG. 15.
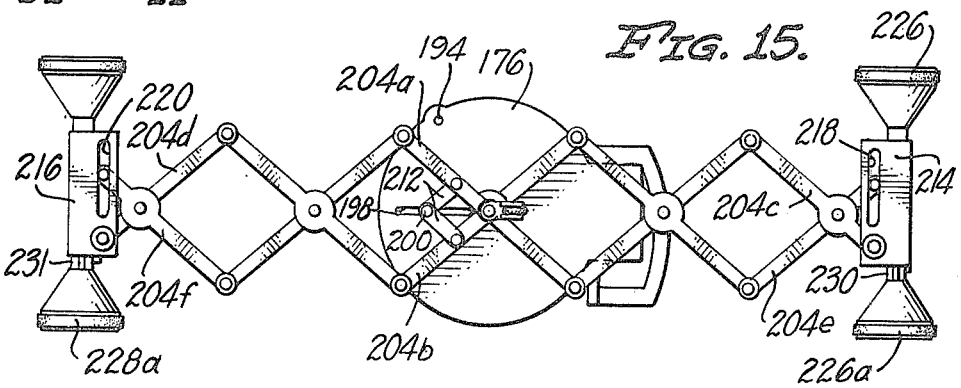

TOYS UTILIZING FLUID PROPULSION DEVICE

BACKGROUND OF THE INVENTION

This invention is directed to a fluid propulsion device and toy vehicles which utilize the fluid propulsion device and move in unique manners. One of the embodiments of the invention utilizes a lazy tong mechanism to propel the toy vehicle. A second of the embodiments of the invention utilizes a plurality of arcuate members which are mounted and rotate off-center to propel the toy vehicle. A third of the embodiments of the invention utilizes moving appendages to propel the toy vehicle. The propulsion device of these embodiments can utilize a toggle action to control a control valve which, in turn, controls charging or exhausting of a pressurized fluid to a cylinder and piston to provide the power for the above described vehicles.

In application Ser. No. 95,785, co-invented by one of us, toy vehicles are described which utilize fluid reservoirs holding compressed gas to drive a fluid engine. The fluid engine drives a drive shaft, which in turn provides rotary motion for wheels or other rotating devices to provide for propulsion of the toy vehicles. The rotary output of the fluid engine in that application provides power for somewhat conventionally shaped vehicles adapted to mimic cars, trucks, motorcycles, airplanes and the like.

The fluid engine and the vehicles adapted to utilize this fluid engine as described in the above referred to patent application have many advantages over other known toy vehicles. The sole source of energy utilized to propel these vehicles is, in essence, "child power." A pump operated by a child is utilized to pressurize a reservoir which in turn drives the fluid engine of the above referred to patent application. No batteries or other expendable energy sources are thus required to operate these vehicles. The child can thus play with the vehicle for as long a period as the child desires without being forced to abandon play because of "dead batteries" and the like.

Because the vehicles described in the above identified patent application utilize a low pressure fluid as the power source, the engine components of the vehicle can be made of transparent material, allowing the child to actually view the working components of the engines. This proves fascinating and stimulating to the mind of the child, and helps the child develop concepts of mechanics.

While the fluid engine and the vehicle which utilize its rotary output of application Ser. No. 95,785 have been highly successful and have contributed considerable play value to the users thereof, they are based on conventional type vehicles which the child encounters in his real world. Often in playing, the child likes to use his imagination and dream up situations which in fact have no concept in reality. To a child, a particular toy vehicle can, in one instance, be a conventional truck, and in a second instance, be a space ship. In view of the inclination of the child to modify his toys into things which in essence have no real counterpart in reality, it is deemed that there exists the need for a series of toy vehicles which are not conventional in nature and which do not operate as per any existing known real-life counterparts.

BRIEF DESCRIPTION OF THE INVENTION

It is a broad object of this invention to provide a set of vehicles and a propulsion device utilized therein which are unique and original in their concepts and have no life-size counterpart in the adult world of reality. It is a further object of this invention to provide a series of vehicles which are both amusing and fascinating to play with. Additionally, it is an object of this invention to provide for a propulsion device for the above identified vehicles which is capable of producing a linear output which can be utilized in many different manners to provide for unique modes of propulsion of the above desired vehicles. Furthermore, it is an object of this invention to provide such devices which, because of their engineering and construction, are not only fun and interesting to use because of their apparent complexity, but which, in fact, are of such construction that they can be produced at a reasonable cost making the device economical to the purchaser.

These and other objects are achieved in a propulsion device comprising a housing; a cylinder located in association with said housing; a means associated with said housing for supplying pressurized fluid to said cylinder; a valve means associated with said cylinder, said valve means having an exhaust port means connecting between the interior of said cylinder and the ambient environment and a supply port means connecting between the interior of said cylinder and said means for supplying pressurized fluid, said valve means having a charging position wherein pressurized fluid from said means for supplying pressurized fluid is introduced into the interior of said cylinder and an exhaust position wherein said fluid within the interior of said cylinder is exhausted to the ambient environment; a piston located in the interior of said cylinder, said piston capable of moving in a power stroke in response to said valve being in said charging position and pressurized fluid being introduced into the interior of said cylinder, said piston capable of moving an exhaust stroke in response to said valve being in said exhaust position; a piston output member operatively associated with said piston and extending out of said cylinder, said piston output member capable of moving linearly in a first direction as said piston moves in said power stroke and linearly in a second direction as said piston moves in said exhaust stroke; a connecting means operatively connecting said piston output member and said valve member, said connecting means including at least a first movable means, a second movable means and a biasing means, said first movable means pivotable with respect to said housing and operatively associated with said valve means, said first movable means pivoting between a first orientation and a second orientation, said valve means located in said charging postion when said first movable means is in said first orientation and said valve means located in said exhaust position when said first movable means is in said second orientation, said biasing means at least passively retaining said first movable means in both of its first and second orientations, said second movable means operatively associated with said first movable means, at least a portion of said second movable means operatively associated with said piston output member and said portion movable with response to movement of said piston output member, said first movable means being movable between its first and second orientation in response to movement of said second movable means.

In the preferred embodiment of the propulsion device, the first movable means is formed as a toggle joint, having a first and second elongated element. Each of the elongated elements has ends and they are movably joined together at one of the ends of each. The toggle joint is located on the housing in association with both the valve means and the piston member with one of the first or second of the elongated elements associated with the valve means and the other of the elongated elements associated with the piston member. The elements of the toggle joint are capable of being located with respect to one another in one of two orientations. The first of these would be a right hand side over-center toggle orientation, and the second would be a left hand side over-center toggle orientation. The valve means would be located in the charging position when the elements of the toggle joint are in one of said orientations, and located in the exhaust position when the elements of the toggle joint are located in the other orientation.

The preferred embodiment of the propulsion device would include said second movable means having a first transfer member formed as a part thereof, with said first transfer member associated with both said toggle joint and said piston member. The first transfer member is capable of transferring movement of the piston member to the second element of said toggle joint.

In the preferred embodiment of the propulsion device, the biasing means would comprise a first biasing element associated with at least one of the first or second elements of the toggle joint. The biasing element is capable of maintaining the first and second elements of the toggle joint in both their right hand side and left hand side over-center toggle orientation. It is constructed however to allow for the first and second elements of the toggle joint to reversibly move back and forth between these two orientations by connecting this first biasing element between the other ends of the first and second elements of the toggle joint.

A second biasing element can be included in the preferred embodiment of the propulsion device. The second biasing element would be associated with the first transfer member and the housing. The second biasing element biases the first transfer member which in turn bias the piston member in its second direction in response to piston movement in the exhaust stroke.

In the preferred embodiment of the propulsion device, the first transfer member would comprise a bell crank pivotally mounted on the housing with the end of one of the arms of the bell crank pivotally attaching to the other end of the second element of the toggle joint. The other of the arms of the bell crank is pivotaly attached to the piston member, with the second biasing member connecting to the end of this other arm or to the piston member for biasing the bell crank and the piston member.

In the preferred embodiment of the propulsion device, the valve means would include a control rod means which is operatively associated with the first element of the toggle joint and moves in response to movement of the first element of the toggle joint. Furthermore, the valve means would include a valve body having an inlet port, an exhaust port and a cylinder port. The exhaust port is open to the ambient environment with the inlet port connected to the means for supplying pressurized fluid, and the cylinder port connecting to the cylinder. A movable element is located within the valve body and is capable of alternatively sealing one or the other of the exhaust port or the inlet port. The movable element would be associated with the control rod means and movable within the valve body such that when the elements of the toggle joint are in one of their right hand side or left hand side over-center toggle orientations, the movable elements seal one of the exhaust port or the inlet port to fluid movement through said port, and when the elements of the toggle joint are in the other of their orientations the movable elements seal the other of the exhaust port or inlet port.

In an embodiment of the propulsion device, a second transfer member can also be utilized. The second transfer member would be operatively associated with the toggle joint. A control means is movably mounted on the housing in operative association with the second transfer member. The first and second elements of the toggle joint move from one of said right hand side over-center toggle orientations to the left hand side over-center toggle orientation or from said left hand side over-center toggle orientation to said right hand side over-center toggle orientation in response to movement imparted to said elements by said first or said second transfer member and moved from the other of said right hand side over-center toggle orientation to said left hand side over-center toggle orientation or from said left hand side over-center toggle orientation to said right hand side over-center toggle orientation in response to movement imparted to said elements by the other of said first or said second transfer members. Preferredly, the first transfer member would be connected to the second element of the toggle joint and the second transfer member would be connected to the first element of the toggle joint. As such, the first element of the toggle joint can be constructed as a bell crank with the second element being pivotally mounted at the elbow of the bell crank and the control rod means being pivotally mounted at the end of one of the arms of the bell crank, with the second transfer element being pivotally mounted to the end of the other arm of the bell crank.

In an embodiment of the invention, a toy vehicle embodiment which can utilize the above described propulsion device would include the vehicle housing having a front and back end. A motion means is associated with the vehicle and would be capable of supporting the vehicle on a surface. At least a portion of the motion means has an arcuate shaped sufface and the motion means is pivotally-attached to the vehicle base about a mounting point on the motion means such that the arcuate portion of the motion means extends downwardly from the vehicle housing and is capable of contacting the support surface. The point of mounting on the motion means would be displaced off-center from the center of rotation of the arcuate surface in a direction toward the front end of the vehicle. A means would be associated with the motion means for rotating the motion means about said mounting point in a direction resulting in the arcuate surface being moved arcuately toward the front end of the vehicle such that when the motion means is rotated in the direction toward the front of the vehicle and the vehicle is located on a support surface, the vehicle moves forward as the motion means rotates in the opposite direction.

Preferredly, the means associated with the motion means for rotating the motion means would comprise the motion means being freely pivotable about the mounting point and the center of gravity of the motion means being displaced off-center from the center of rotation of the arcuate surface in a direction toward the back end of the vehicle. The motion means would preferredly comprise a plurality of motion members each having an arcuate surface and each being freely pivotably mounted about a mounting point on the base. Each of the motion members would include an arcuate shaped surface with the mounting point of each of the motion members being displaced off-center from the center of rotation of the respective arcuate surface in a direction toward the front of the vehicle.

Preferredly, the plurality of motion members would be divided into two groups, with each group independently capable of supporting the housing on the surface. A support means is included and would be movably mounted on the housing with the groups of the motion members attaching to the support means. A means would be associated with the support means for moving the support means on the housing in a manner such that first one of the groups of the motion members contacts the support surface and the vehicle moves forward as the motion means of that group rotate in one direction, while the motion means of the other group are lifted upwardly from the surface and rotate in the opposite direction, followed by the other of the groups contacting the support surface and the vehicle moving forward as the motion members of this other group of motion means rotate in the one direction while the motion members of the first group move in the opposite direction.

The preferred means associated with the support means for moving the support means is the preferred fluid propulsion device described above. It is mounted on the vehicle base and is operatively associated with the support means. When so using the preferred propulsion means, the support means would be composed of two support members pivotally mounted on the vehicle base and operatively connected to one another such that they move in unison with one another. The propulsion device is operatively connected to at least one of these support members such that the support members are moved with respect to the vehicle base. A portion of each of the two groups of the motion members would be pivotably mounted to each of the two support members. As such, the members of the first group of motion members mounted on the two support members would contact the surface, propelling the vehicle while the members of the second group of motion members mounted on the two support members would be lifted up above the support surface, followed by reversal of the two groups of members with respect to their position.

In a second embodiment of a toy vehicle of the invention which can utilize the propulsion device described above, the vehicle would have a base having a front and back ends. An expansion means is mounted on the vehicle base and is capable of supporting the vehicle on a surface. The expanding means would be capable of expanding and contracting with respect to itself and would include at least two surface contact means located on the extremities of the expanding means. One of the surface contact means would be capable of essentially engaging a support surface as the expanding means expands, and be further capable of freely moving on the surface when the expanding means contracts. The other of the surface contact means would be capable of engaging the support surface as the expanding means contract and be freely movable on the surface as the expanding means expands.

Preferredly, the expanding means would include at least two members movably mounted with respect to one another such that they can move between an expanded orientation and a contracted orientation. The surface contact means would be located on the extremities of the totality of these two movable members when the two movable members are in the expanded orientation. More preferredly, the two movable members would comprise two members of a plurality of members which together are movably associated together as a lazy tong element. Each of the surface contact means would comprise at least one wheel rotatably mounted on one of the ends of the lazy tong element. Each of the wheels would include a ratchet means associated with the wheels such that the wheel is only capable of rotating freely in one direction. Preferredly, a pair of wheels would be located on each of the ends of the lazy tong elements with at least one member of each of the pairs of wheels including the ratchet means to restrict rotation of that wheel in only one direction.

When the preferred propulsion device of the invention as described above is utilized to propel the lazy tong vehicle, a linking means is associated with both the lazy tong element and the piston member of the preferred propulsion device and is capable of expanding and contracting the lazy tong element in response to movement of the piston member in its first and second directions.

In even a further embodiment of a toy vehicle of the invention, the toy vehicle of this embodiment would be capable of propelling itself in a hopping motion over a surface. The vehicle of this embodiment would include a vehicle base having at least one front and one rear appendage. The front and rear appendages both have a contact end capable of contacting a support surface with the front appendage movably mounted on said housing about a mounting point on the appendage which is distal from the contact end and the rear appendage is also movably mounted on the housing about a mounting point which is also distal from the contact end on the rear appendage. A means is located on the vehicle base and is operatively associated with both the front and rear appendages for simultaneously moving both the front and rear appendages with respect to the base. The front and rear appendages would be sized and shaped such that the distance between the respective contact ends on the front and rear appendages would remain essentially constant as these appendages move with respect to the housing when the contact ends on the front and rear appendages are in contact with the support surface. Movement of the front and rear appendages with respect to the base imparts a thrust to the base both upwardly and forwardly such that the housing is thrust upwardly and forwardly with respect to the support surface, moving the vehicle in a hopping-like manner.

Preferredly, the vehicle would include a set of front appendages and a set of rear appendages. The members of the front set of appendages would be located on alternate sides of the vehicle and the members of the set of rear appendages would also be located on alternate sides of the vehicle. The members of the set of front appendages move in unison with respect to one another, as do the members of the set of rear appendages.

Preferredly, the rear appendage would include a lower link and at least one upper link pivotally joined together. More preferredly, two upper links would be utilized, with each of the upper links independently pivotally mounted to the lower link with the first of the upper links pivotally mounted on the base and the second of the upper links movably mounted on the vehicle base. Preferredly, the front appendages would be first class levers pivotally mounted on the base with the second of the upper links of the rear appendages pivotally attached to the end of the front appendage distant from its contact end. Preferredly, a joining link would be attached to those ends of the two upper links of the rear appendage which are not pivotally joined to the lower link. As such, the upper links move in a parallel relationship to one another as the rear appendage moved with respect to the base.

The immediately described embodiment of the invention would preferredly utilize the embodiment of the propulsion device which includes the second transfer member. The control means of this embodiment would include a control member mounted on the vehicle base. The control member would be positioned on the base to contact the support surface when the vehicle base is in its closest relationship with the support surface. This would trigger movement of the first and second elements of the toggle joint such that the valve means would move from the exhaust position to the charging position. Preferredly, the front and rear appendages would move with respect to the base such that the vehicular base would be thrust away from the support surface upwardly and forwardly in response to movement of the front and rear appendage. The first transfer member then causes the first and second elements of the toggle joint to move the valve means from its charging position to its exhaust position, allowing retraction of the appendages and movement of the base back toward the support surface until the control member contacts the support surface to move the valve means back to the charging position and restarting the cycle.

BRIEF DESCRIPTION OF THE DRAWINGS

The invention described in this specification will be better understood when taken in conjunction with the drawings wherein:

FIG. 1 is a diagramatic representation of the procedure and elements utilized in charging the propulsion device of the invention;

FIG. 2 is a front elevational view in partial section of one of the embodiments of the propulsion device of the invention, taken about the lines 2—2 of both FIGS. 11 and 16 with the components of this FIG. shown in a locked position;

FIG. 3 is a side elevational view in section about the line 3—3 of FIG. 2;

FIG. 11 is a side elevational view of one of the embodiments of the toy vehicle of the invention;

FIG. 12 is a bottom plan view of the embodiment as seen in FIG. 11;

FIG. 13 is a top plan view about the line 13—13 of FIG. 11;

FIG. 14 is a side elevational view in section about the line 14—14 of FIG. 12;

FIG. 15 is a bottom plan view similar to FIG. 12 with the exception that certain of the components of the invention as seen in FIG. 12 are shown in a different spatial relationship than as seen in FIG. 12;

Figure 4:
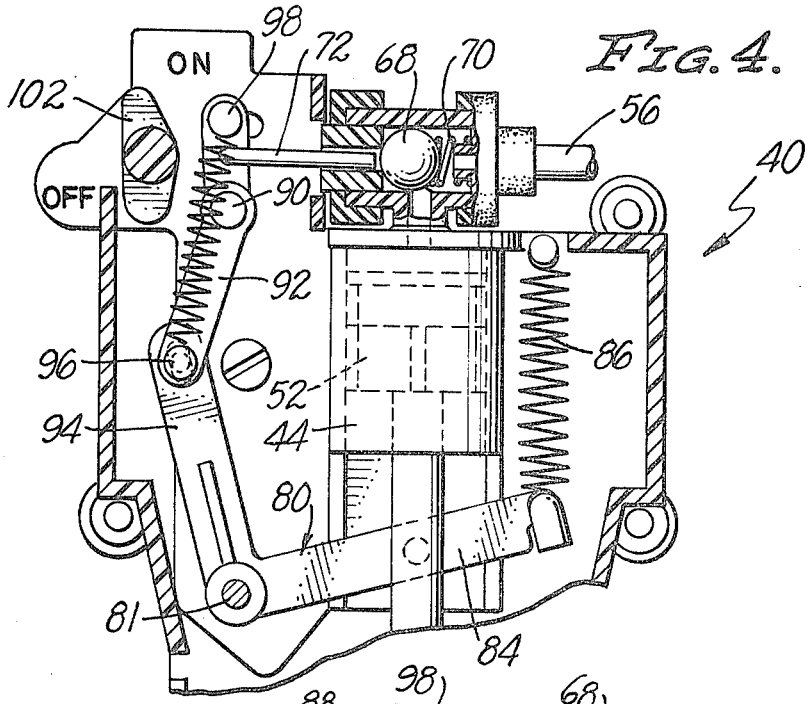
FIG. 4 is a front elevational view in partial section of the embodiment depicted in FIG. 2 with certain components of this embodiment shown in different spatial orientation than that seen in FIG. 2 and with certain overlaying components being present.

The invention decsribed in this specification and illustrated in the drawings utilizes certain principles and/or concepts as are set forth in the claims appended hereto. Those skilled in the toy arts will realize that these principals and/or concepts can be utilized in a variety of embodiments differing from the illustrated embodiments utilized herein. For this reason, this invention is not to be construed as being limited to the exact illustrated embodiments, but is to be construed only in light of the scope of the claims.

DETAILED DESCRIPTION OF THE INVENTION

FIG. 1 illustrate in a somewhat diagramatic manner the charging and storing of gas under pressure and its utilization by one embodiment of the fluid engine of this invention. FIGS. 2 through 5 describe in detail the embodiment of the fluid engine seen in FIG. 1. FIGS. 5 through 10 describe in detail an alternate embodiment of the invention of FIG. 1 which includes several additional components to that as seen in FIG. 1, which augments the manner of switching between an exhaust and charging cycle. FIGS. 11 through 15 illustrate a first alternate embodiment of a toy vehicle which utilizes the fluid engine of FIGS. 1 through 6. FIGS. 16 through 19 illustrate a further embodiment of the toy vehicle which utilizes the embodiment of the fluid engine of FIGS. 2 through 5, and FIGS. 20 through 23 illustrate an embodiment of a toy vehicle which utilizes the embodiment of the fluid engine as seen in FIGS. 6 through 10.

Basically, the two embodiments of the fluid engine utilized herein for illustrative purposes, utilize a toggle mechanism to control a valve which in turn controls the charging and exhausting of a cylinder. The two embodiments of the fluid engine differ in the manner in which the valve is controlled by the toggle mechanism.

The three embodiments of toy vehicles as illustrated in FIGS. 11 through 23 depict unique vehicles which are propelled across a surface utilizing mechanisms not normally associated for the propulsion of vehicles. In FIGS. 11 through 15, a lazy tong type mechanism is utilized for propulsion of the vehicle. In FIGS. 16 through 19, arcuate sections of circles which are pivotally mounted at a point off-center from the center of rotation of the arcuate surface are utilized to propel the toy vehicle and in FIGS. 20 through 23, a vehicle is illustrated which moves across a surface by utilizing a hopping or jumping type action, which is achieved by the particular mechanism of this vehicle.

In FIG. 1, a pump 30, conventional in nature, is utilized to deliver pressurized fluid through line 32. The line 32 is inserted into a check valve 34 which is in communication with a fluid storage reservoir 36, a pressure relief valve 38 and the first embodiment of the fluid engine of the invention 40. The reservoir 36 is charged with pressurized air to a pressure set by the pressure relief valve 38. During charging, an off/on member 102 maintains the fluid engine 40 static, and prevents escape of pressurized air as hereinafter explained. The check valve 34 and the pressure relief valve 38 are conventional in construction, and as such, detailed description of the same need not be given. They serve to allow introduction of pressurized air from the pump 30 to the reservoir 36 and prevention of escape of that air by the check valve 34 or exceeding the pressure limits of the reservoir 36 by the relief valve 38. In charging the reservoir 36, the line 32 is connected to the check valve 34 and the reservoir 36 is pressurized. When the pressure as governed by the relief valve 38 is reached, the child utilizing the toys constructed as per this invention then disconnects the line 32 from the check valve 34 and the toy is ready for use.

Referring now to FIGS. 1 through 6 the first embodiment of the fluid engine of the invention is described. In this embodiment, a housing plate 42 is utilized to support the remaining components and further utilized to attach the fluid engine 40 to a toy vehicle as hereinafter described. A housing cover 43 fits on the plate 42. The housing plate 42 and cover 43 are generally made of a clear plastic, allowing for viewing of all of the components attaching thereto, such that a child may view the internal workings of the fluid engine 40 as it operates. In any event, the housing plate 42 provides a support for the other components. A cylinder 44 is located on the housing plate 42. The cylinder 44 has a open bottom end 46. The top of the cylinder 44 is closed except for a cylinder port 48. Located on top of the cylinder 44 is a valve body 50. The interior of the valve body 50 communicates with the interior of the cylinder 44 via the cylinder port 48. In actual production both the cylinder 44 and the valve 50 are integrally formed as a part of the housing plate 42 in a molding operation. They could, however, be formed as seperate structures and be appropriately mounted onto the housing plate 42.

A piston 52 is located in the interior of cylinder 44. The piston 52 is formed with a rubber sealing member 54 mounted thereon. The rubber sealing member 54 seals against the sides of the cylinder 44, making a somewhat fluid-tight seal. Piston 52 reciprocates up and down within cylinder 44 based upon fluid pressure introduced via valve body 50 through cylinder 48 to the interior of the cylinder 44.

A fluid line 56 leads from the reservoir 36 to the valve 50. An inlet port 58 is formed in a boss 59 located within the interior of the valve 50 and formed as a part of the valve 50. The inlet port 58 feeds fluid into the interior of the valve 50. A rubber sealing member 60 seals the fluid line 56 to the valve 50.

Figure 5:
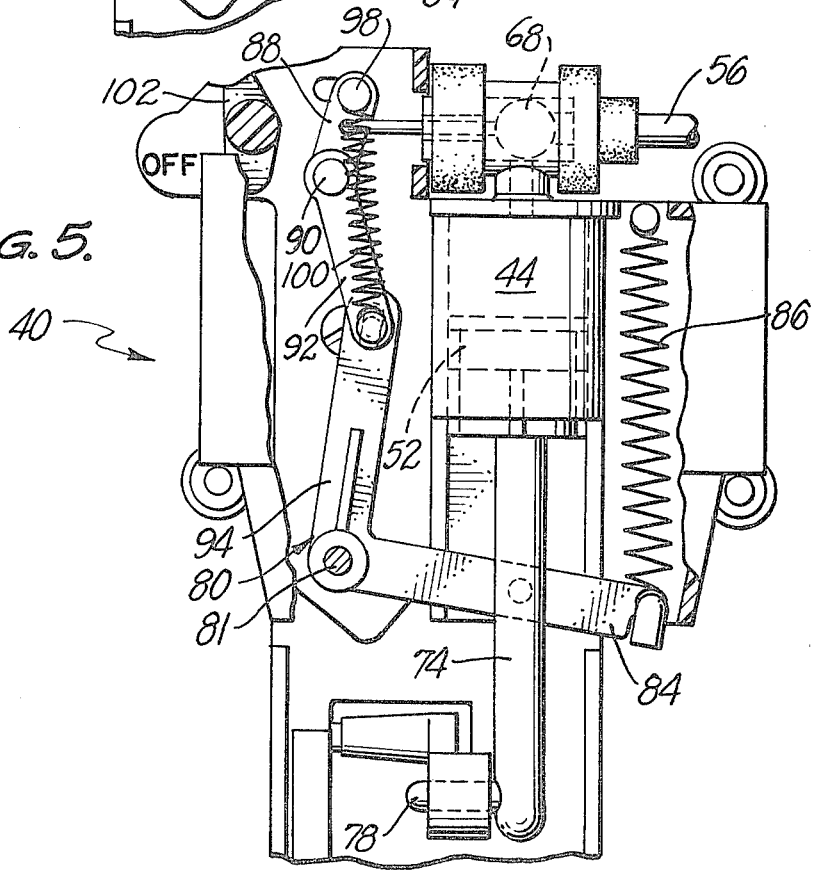
FIG. 5 is a front elevational view in partial section depicting the same components seen in FIGS. 2 and 4 with the exception that these components are seen in a different spatial relationship and that certain overlaying components are illustrated.

On the other side of valve 50 is a cylinder 62 having an exhaust port 64 located therein. The opening 64 serves to exhaust fluid from the valve 50. The cylinder 62 is sealed to the valve 50 via rubber sealing member 66. A check ball 68 is located within the valve 50. The check ball 68 is able to seal against the inlet port 58 forming a seal between the reservoir 36 and the interior of the valve 50 as well as sealing against the exhaust port 64 to form a seal between the ambient environment and the interior of the valve 50. When the check ball 68 is in the position as seen in FIGS. 2 and 5, the interior of the cylinder 44 is in communication with the ambient environment via cylinder port 48 and exhaust port 64 and when the check ball 68 is in position as seen in FIG. 4, the interior of the cylinder 44 is in communication with the reservoir 36 via the cylinder port 48 and the inlet port 58.

A spring 70 located around the boss 59 serves to bias the check valve 68 toward the exhaust port 64. A rod 72 passes through the exhaust port 64 and is in communication with the check ball 68. Movement of the rod 72 will be as hereinafter described. The diameter of the rod 72 is less than the diameter of the exhaust port 64 such that a pathway between the interior of valve 50 and the ambient environment exists by oversizing the exhaust port 64 with respect to the diameter of the rod 72. As is seen in FIG. 4, when the rod 72 is moved to the left with respect to the exhaust port 64, the spring 70 biases the check ball 68 to seal the exhaust port 64.

A piston member 74 contacts the bottom of piston 52 and extends out of the open bottom end 46 of the cylinder 44. Piston member 74 has a boss 76 located thereon and a second boss 78 at its lower end, placed at a right angle to the boss 76. The bosses 76 and 78 serve as attachment members for the components of the engine and the toy vehicle to which it is attached. The boss 78 serves as a linking member to which other members are attached for propelling the different embodiments of toy vehicles, as hereinafter explained. The boss 76 serves as a linking member with a bell crank 80. Bell crank 80 is pivotally mounted about a boss 81 which is formed on the housing plate 42. An opening 82 formed in an arm 84 of bell crank 80 fits around boss 76 such that motion of the piston member 74 is transferred to bell crank 80. A spring 86 connects between the end of arm 84 and the housing plate 42. The spring 86 biases the arm 84 upwardly, which in turn biases the piston member 74 and piston 52 upwardly and the bell crank 80 counterclockwise.

A first toggle element 88 is pivotally mounted to axle 90, which in turn is mounted to housing plate 42. Valve rod 72 has a 90 degree bend on its left hand side, and fits into an appropriate hole located in first toggle element 88. Movement of the valve rod 72 therefore is in direct response to movement of the first toggle element 88 about axle 90. A second toggle element 92 is pivotally mounted at its upper end on axle 90. Its lower end is slidably mounted to the other arm 94 of bell crank 80 via pin 96 which fits into slot 97 formed in the end of arm 94. A pin 98 is located on the upper end of first toggle element 88. A spring 100 connectes between pins 96 and 98.

Together, the first toggle element 88 and the second toggle element 92 form a toggle joint. Referring to FIG. 4, it is seen that the first and second toggle elements 88 and 92 can be located in a right hand side, over-center toggle orientaiton and passively held in this orientation by spring 100. In FIG. 5, the first and second toggle elements 88 and 92 respectively, are in a left hand side over-center toggle orientation and passively maintained there also by spring 100.

When valve 50 is in its exhaust position piston 52 is near the top of its stroke and piston member 74, because of the bias imparted to them via spring 86 acting on arm 84 of the bell crank 80, move upwardly in cylinder 44. This can be seen in FIG. 4. When the piston 52 is near its upper limit of travel of its exhaust stroke, the other arm 94 of the bell crank 80 moves to the left, which in turn moves the lower end of the second toggle element 92 to the left. This moves the bottom of the spring 100 such that the spring 200 is located to the left of the center of the axle 90. This biases the upper end of the first toggle member 88 to rotate about the axle 90 such that the upper end of the first toggle element 88 moves to its limit of travel to the left, pulling the valve rod 72 through the opening 64 and releasing the check ball 68 such that it can close off the exhaust port 64. This allows introduction of pressurized air via the line 56 into the valve 50 and through the cylinder port 48 into the cylinder. The presence of the pressurized air within the cylinder 44 pushes downwardly on the piston 52 causing it to travel downwardly in the cylinder 44.

In FIG. 5 the piston 52 is seen near its lower limit of travel within the cylinder 44. As the piston 52 travels down under the influence of pressurized air within the cylinder 44, it pushes the piston member 74 downwardly, which in turn rotates the bell crank 80 about boss 81 and stretches the spring 86. Movement of the bell crank 80 in a clockwise manner as thus depicted causes the lower end of the second toggle element 92 to be moved to the right. As the toggle element 92 rotates about the axle 90, it brings the spring 100 over the center of the axle 90 until it is on the right hand side of the axle 90. This then biases the upper end of the first toggle element 88 to the right until it moves to the position as shown in FIG. 5. With the movement of the upper end of the toggle element 88 to the right, the valve rod 72 moves inwardly within the exhaust opening 64 and lodges against the check ball 68, pushing it to the right against the bias of the spring 70, until the check ball 68 seats against the inlet port 58. This seals the interior of the cylinder 44 from the pressurized fluid in the reservoir 36.

When the pressurized fluid from the reservoir 36 is no longer being introduced into the cylinder 44, the piston 52 now rises within the cylinder 44 under the influence of spring 86 acting via the bell crank 80 and the piston member 74. As the piston 52 travels upwardly within the cylinder 44 it allows counterclockwise rotation of bell crank 80, which in turn moves the bottom end of the second toggle element 92 to the left to again initiate the cycle.

FIG. 2 illustrates the use of the off/on switch 102. The off/on switch 102 is pivotally mounted to the housing plate 42 such that it can be in the orientation as seen in FIG. 2 or the orientation as seen in FIGS. 4 and 5. When it is in the orientation as seen in FIGS. 4 and 5, the fluid engine 40 is in the "on" mode, and it can operate as previously described. When the off/on switch 102 is positioned horizontally as seen in FIG. 2, it abutts against the first toggle element 88 pushing it to the right. This in turn causes the check ball 68 to seal the inlet port 58 and prevent introduction of pressurized air from the reservoir 36 to the interior of the cylinder 44. When pumping up the reservoir 36, the off/on switch 102 is normally placed in the "off" position to prevent loss of fluid from the reservoir 36.

A small groove 104 is formed in the housing plate 42 directly behind the first toggle element 88. An extension 106 located on the back of the first toggle element 88 fits into the groove 104 and limits the amount of travel to the right and the left of the top of first toggle element 88. When as seen in FIG. 4, the first toggle element 88 is located in its extreme left hand position because of the interaction of the extension 106 in the left hand side of groove 104. Normally, the extension 106 does not contact the right hand side of groove 104, but the limits of travel of the top of toggle element 88 to the right is governed by seating of the check ball 68 against the inlet port 58.

The output of the fluid engine 40 is a back and forth reciprocal output based on movement of the piston member 74. As noted above, the boss 78 formed on piston member 74 is utilized to power toy vehicles of the invention described below.

In summary, it is evident from the above description and from FIGS. 2 through 5, that when the off/on button is vertical and thus does not interfere with the movement of the toggle joint, the elements 88 and 92 of the toggle joint automatically control the valve 50. The elements of the toggle joint in turn are controlled by the movement of the bell crank 80, which in turn is controlled by the movement of the piston member 74 and the spring 86. When the piston 52 is nearing the top of the cylinder 44, the toggle joint automatically interacts with the valve 50 to introduce pressurized air into the cylinder 44, causing the piston 52 to move downwardly. When the piston 52 is at its bottom of its stroke distal from the end of the cylinder 44 wherein the cylinder port 48 is located, its movement causes the toggle joint to move the toggle members 88 and 92 such that they cause the valve 50 to open the exhaust port 64 and close the inlet port 58, allowing for an exhaust stroke of the piston in an upwardly direction toward the cylinder port 48 under the bias of spring 86.

FIGS. 6 through 10 illustrate an alternate embodiment of the propulsion device of the invention. In this embodiment, the fluid engine 108 is illustrated. Many of the components of the fluid engine 108 are exactly equivalent to the components previously illustrated for the fluid engine 40. As such, a detailed description of these components is not necessary, and like numerals will be utilized to describe identical components between the fluid engine 108 and the fluid engine 40.

The valve 50 of the fluid engine 108 is identical to the valve 50 of the fluid engine 40. The cylinder 110 and the piston 112 located therein are also functionally equivalent to the cylinder 44 and piston 52 of the previously described fluid engine with the exception that they are slightly oversized with respect to the previously described cylinders, as evident from comparing the size of these items in FIG. 6 versus FIG. 2.

Figures 6, 7, 8, 9, 10:
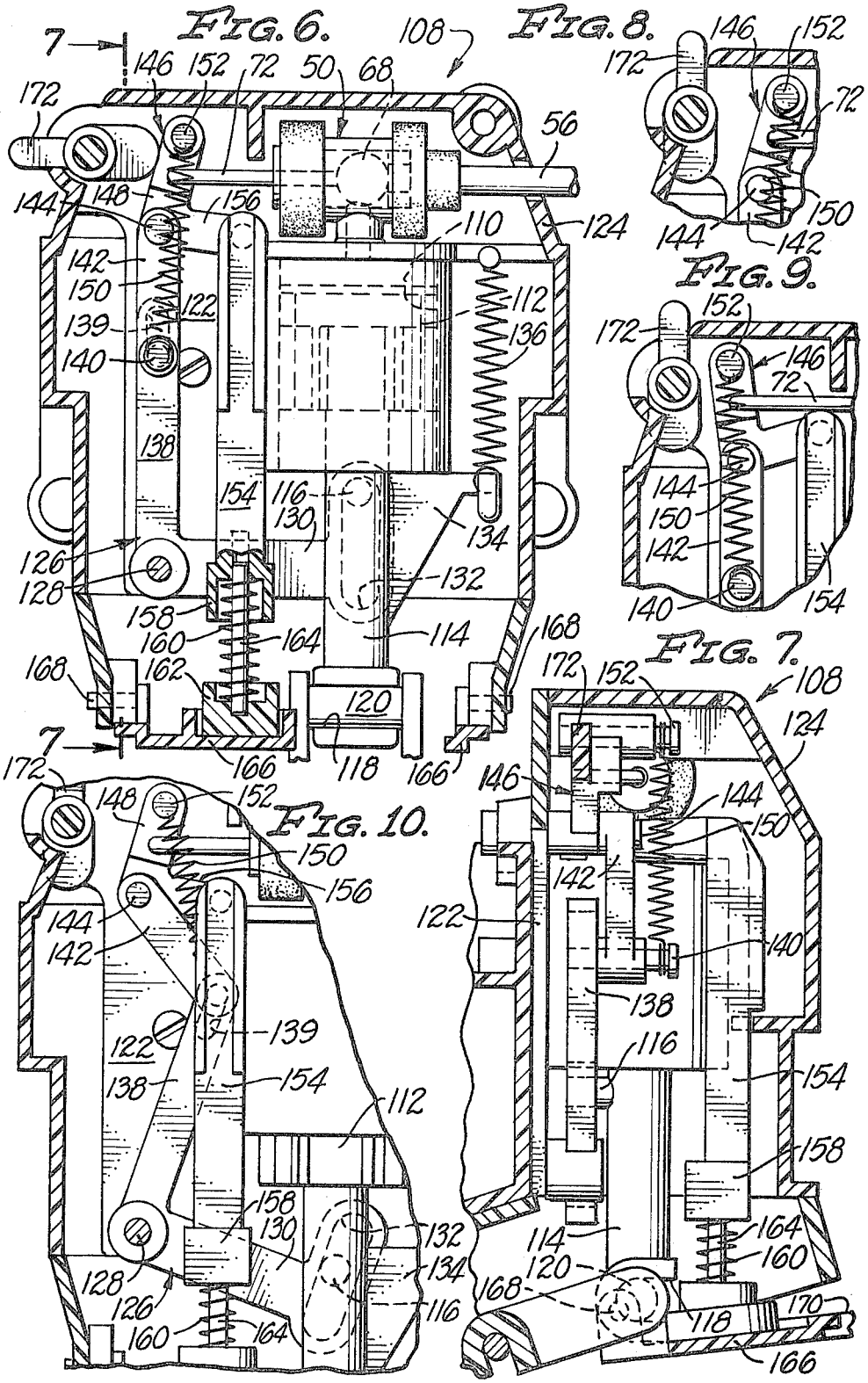
FIG. 6 is a front elevational view in partial section of an alternate embodiment of the propulsion device of the invention.
FIG. 7 is a side elevational view about the line 7—7 of FIG. 6.
FIG. 8 is a front elevational view in partial section showing certain of the components located in the upper left hand corner of FIG. 6 with these components in a different spatial orientation than as seen in FIG. 6.
FIG. 9 is a view similar to FIG. 8, except certain of the components shown therein are shown in a different spatial relationship than that seen in either FIGS. 6 or 8.
FIG. 10 is a front elevational view in partial section showing the elements of FIG. 6 located along the left hand side of FIG. 6 and showing certain components in a different spatial relationship than seen in FIG. 6.
Figure 21:
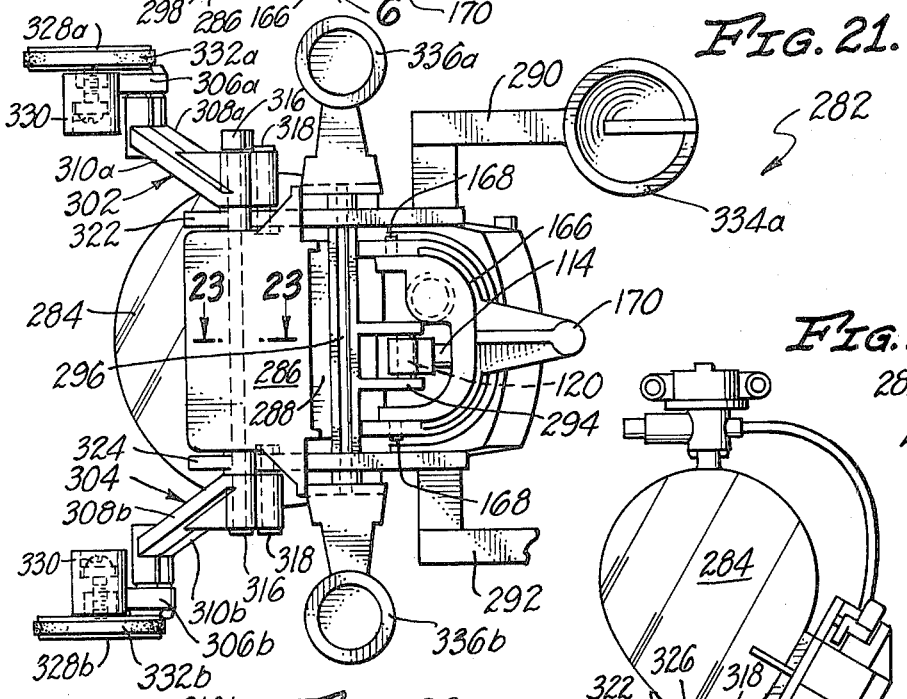
FIG. 21 is a bottom plan view of the embodiment of FIG. 20.

The piston member 114 has a boss 116 located approximately at its middle, which projects forward from the piston member 114. The bottom end of the piston member 114 is formed to include a slot 118 which can fit around an appropriate axle, such as axle 120 as seen in FIGS. 6 and 21. The output of the fluid engine 108 is via the interaction of the piston member 114 with the axle 120 by appropriately locating the axle 120 in the slot 118 on the piston member 114.

A housing plate 122 forms the support for the fluid engine 108 and includes a cover component 124. Both of these are preferentially made out of a transparent plastic allowing for viewing of the interior workings of the fluid engine 108. As with the previously described embodiment, the cylinder 110 as well as the valve 50 can be integrally formed with the housing 122 during production.

A bell crank 126 is pivotally mounted about boss 128 formed on housing plate 122. On the end of arm 130 of bell crank 126 is an elongated area having an opening 132 located therein. The boss 116 on piston member 114 fits within the opening 132. An extension 134 is formed on the side of the piston member 114. A spring 136 connects between extension 134 and housing plate 122. This biases the piston member 114 upwardly, which in turn biases piston 112 upwardly within cylinder 110.

As the piston 112 and the piston member 114 extend downwardly because of introduction of pressurized fluid through valve 50 into cylinder 110, this motion is not immediately communicated to bell crank 126 because of the elongation of the opening 132. At such time as the piston 114 nears the limit of travel downwardly within the cylinder 110, the boss 116 contacts the bottom wall of the opening 132 and thus engages it and transfers further downward motion of the piston member 114 to the bell crank 126 rotating it clockwise.

The other arm 138 of bell crank 126 contains an elongated slot 139 located in its uppermost extremity. A pin 140 located in the bottom end of a second toggle extension 142 fits within the opening 139. The second toggle extension 142 is pivotally mounted about pin 144. Also pivotally mounted about pin 144 is bell crank 146. The vertical arm 148 of bell crank 146 acts as a first toggle element equivalent in some respects in function to the first toggle element 88 described for the previous engine 40. Valve rod 72 is pivotally mounted to the arm 148. A spring 150 extends between a pin 152 located in the upper portion of arm 148 and pin 140 previously described. The spring 150 biases the toggle element 142 as well as the arm 148 on bell crank 146 which, as noted above, also forms a toggle element.

When arm 148 of bell crank 146 and toggle element 142 are in the orientation as seen in FIGS. 8 and 10, the valve rod 72 moves the check ball 68 such that the inlet port leading to cylinder 110 is closed and the exhaust port 64 leading from cylinder 110 is open. When the arm 148 and the toggle extension 142 are in the configuration as seen in FIG. 9 the valve rod 72 is moved to the left such that check ball 68 closes the exhaust port 64 of the valve 50 and allows pressurized fluid via line 56 to be introduced into the cylinder 110.

A sliding member 154 is pivotally attached to the other arm 156 of bell crank 46. The lower end of sliding member 154 contains a cage 158 which serves to hold the upper end of a compression spring 160. A second cage 162 is shaped to hold the lower end of spring 160 and rod 164 extends between the two cages 158 and 162 to maintain them in alignment. The rod 164 is free to slide up and down in an appropriate drilling in the bottom of sliding member 154.

An activation member 166, as seen in FIG. 7 in side view, and in FIG. 6 in sectional view, is pivotally mounted about axle sections collectively identified by numeral 168 in a support surface as, for instance, the toy of embodiments seen in FIGS. 20 through 23. When the end 170 of activation button 166 is moved upwardly as hereinafter explained in greater detail in explaining the embodiment of FIGS. 20 through 23, the upward movement of the activation button 166 is transferred via compression spring 160 to the sliding member 154. This in turn transfers movement to bell crank 146 via arm 156. This rotates the bell crank 146 counter-clockwise, which in turn moves the valve rod 72 to the left allowing for closing of the exhaust port in valve 50.

An off/on button 172 is pivotally mounted to the housing plate 122 and as seen in FIG. 6, turns the fluid engine 108 off by causing clockwise movement of the bell crank 146, which in turn, via valve rod 72, seals the valve 50 to the introduction of pressurized air into the cylinder 110. When the off/on button 172 is rotated as per FIGS. 8, 9 or 10, it no longer contacts the bell crank 146 and the fluid engine 108 is free to operate.

The fluid engine 108 operates slightly differently than the fluid engine 40 previously described. Whereas the fluid engine 40 previously described automatically cycled itself such that the valve was moved between a charging and an exhaust position, the fluid engine 108 operates slightly differently. When the piston 112 is near its upwardmost position within the cylinder 110, the bell cranks 138 and 146, as well as the toggle element 142 and the spring 150 are as seen in FIGS. 6 and 8. At this time, the valve rod 72 is maintaining the valve 50 in the exhaust position such that no pressurized fluid is being introduced into the cylinder 110. As can be seen in FIG. 8, the spring 150 is still to the right of the pin 144 and thus the toggle joint composed of the element 142 and the arm 148 is still in a right hand side over-center toggle orientation. Only upon upward movement of the activation member 166 and corresponding upward movement of the sliding member 54 with the accompanying counterclockwise movement of bell crank 146 is the toggle joint composed of the toggle element 142 and the arm 148 of the bell crank 146 flipped to a right hand side over-center toggle orientation. This is as depicted in FIG. 9. When this happens, the valve rod 72 moves to the left such that valve 50 is then moved to the charging position, allowing introduction of pressurized fluid into the cylinder 110. This causes downward movement of the piston 112, the piston member 114 and, at a certain point in the movement of the piston member 114, clockwise rotation of bell crank 126. As seen in FIG. 10, with the clockwise rotation of the bell crank 126 the toggle element 142 is rotated counterclockwise such that the spring 150 is flipped to the left hand side of the over-center toggle orientation which, in turn, under the bias of spring 150 rotates the bell crank 146 clockwise, moving the valve rod 72 to the right and once again putting the valve 50 in the exhaust position.

The fluid engine 108 thus is a stepwise engine. The downward movement of the piston 142 during introduction of pressurized fluid into the cylinder 110 automatically proceeds as soon as the bell crank 146 is rotated counterclockwise. The downward motion of the piston member 114 however, is not sufficient to rotate the bell crank 126 clockwise enough to trip the toggle joint to the right hand side over-center toggle orientation. Only when the activation button 166 is tripped does this happen. Utilization of the fluid engine 108 will be further described in association with the vehicle embodiment depicted in FIGS. 20 through 23.

Referring now to FIGS. 11 through 15, an embodiment of a toy vehicle utilizing the principles of the invention is illustrated. The lazy tong vehicle 174 is shown in FIG. 11 in a side elevational view with its lazy tong member hereinafter described in a contracted configuration. This is also depicted in bottom plan view in FIG. 12. FIG. 15 shows the lazy tong member in an extended configuration. The fluid engine 40 previously described is utilized to drive the vehicle 174. FIG. 2, previously described, in fact illustrates the drive portion of the lazy tong vehicle 174 taken about the lines 2—2 in FIG. 11.

The lazy tong vehicle 174 incorporates a base 176. Mounted on this base 176 is a fluid reservoir 178. A check valve 180 is mounted on the top of the fluid reservoir 178. An appropriate hose leading from a pump, such as hose 32 leading from pump 30 previously described, is connected to the valve 180 to fill the fluid reservoir 178 with compressed air. Located on top of the valve 180 is relief valve 182. Insofar as both the check valve 180 and the relief valve 182 are conventional in construction a detailed consideration of their exact structure is not necessary for understanding of the invention. In any event, the reservoir 178 is pressurized to the release point of the relief valve 182. Pressurized air is then led from the reservoir 178 via fluid line 184 to the fluid engine 40. Off/on switch 102 is utilized to control the function of the fluid engine 40.

The piston member 74 having boss 78 located on its end extends downwardly from the engine 40. A bell crank 186 pivotally mounted about axle 188 has one of its arms (not seperately identified or numbered) in operational engagement with the boss 78 on the piston member 74. The axle 188 to which the bell crank 186 is connected is appropriately mounted in the base 176.

A link 190 extends below the reservoir 178 on base 176. One end of the link 190 is pivotally attached to the bell crank 186 and motion of the bell crank 186 about its axle 188 therefore moves the link 190 back and forth. The interaction of the link 190 with a portion of the bell crank 186 is seen in FIG. 13. A second link 192 is pivotally mounted about pin 194 attaching to the base 176. The link 190 pivotally attaches to the link 192 via pin 196. A slot 198 is formed in the base 176 such that an extension 200 slidably mounted in slot 201 on the other end of link 192 can project downwardly through the slot 198. The extension 200 moves linearly within the slot 198 in response to movement of the link 192, which ultimately moves in response to the up and down movement of the piston member 74.

The lazy tong 202 is composed of a plurality of members collectively identified by the numeral 204 and, where necessary, individually identified with an alphabetical character affixed thereto. In any event, the lazy tong 202 is pivotally attached to the base 178 via pin 206. Also attaching to pin 206 is a small swivel 208 having a wheel 210 rotatably mounted therein. The swivel 208 and wheel 210 form a movable contact point to help support the lazy tong vehicle 174 when the lazy tong 200 is completely extended if a child utilizing the vehicle 174 pushes down on that vehicle at that time.

Attaching to the members **204*a* and 204*b* are two linking members collectively identified by the numeral 212. Both of these linking members are pivotally attached at one of their ends to the extension 200 and pivotally attached at the other of their ends to the members 204. As the extension 200 slides within the slot 198 its movement is transferred to the lazy tong 202 via the link provided by the linking members 212 to the members 204. In effect, the two linking members 212 and portions of the lazy tong members 204*a* and 204*b* form a parallelogram which is fixed at one point about pin 206 and movable about the point wherein the link members 212 connect to extension 200 and where the linking members 212 connect to the members 204**.

Two axle supports, front axle 214 and rear axle support 216 are pivotally joined to lazy tong members **204*c* and 204*d* respectively. They are slidably joined to lazy tong members 204*e* and 204*f*. It can be seen in viewing FIGS. 12 and 15 that as the lazy tong 202 expands and contracts, the ends of the sliding members 204*e* and 204*f* slide back and forth respectively in slots 218 and 220 located in the axle supports 214 and 216 respectively. In any event, the axles supports 214 and 216 are attached to the respective ends of the lazy tong 202**.

An axle 222 is supported in axle support 214 and an identical axle 224 is supported in axle support 216. A set of front wheels 226 are appropriately located on the ends of axles 222 and a set of back wheels 228 are appropriately located on the ends of axle 224. A set of ratchet teeth 230 is located on the wheel **226*a* and an identical set of ratchet teeth 231 is located on wheel 228*a*. The other wheels 226*b* and 228*b* do not contain the ratchet mechanism. Both of the front wheels 226*a* and 226*b* are fixedly attached to the axle 222 and rotate in unison, and the back wheels 228 are likewise affixed to the axle 224 and rotate in unison. The ratchet teeth 230 and 231 allow for only clockwise rotation of the wheels 226 and 228**. Counterclockwise rotation is prevented.

FIG. 14 shows the ratchet mechanism in detail. The wheel **226*a* has the ratchet teeth collectively identified by the numeral 230 located thereon. The axle support 214 has a stop 232 located thereon. The axle support 214 has a rectangular shaped opening 234 through which the axle 222 passes. This allows for back and forth movement of the axle 222. When the axle 222 is moved to the right as seen in FIG. 14, one of the ratchet teeth 230 engages the stop 232 preventing rotation of the wheel 226*a* and the axle 222. When the axle 222 is moved to the left within the opening 234 the ratchet tooth 230*a* comes free of the stop 232 allowing for rotation of both the wheel 226 and the axle 222. As viewed in FIG. 14, this prevents clockwise rotation of the axle 222 but allows for counterclockwise rotation. Since FIG. 14 is taken about the line 14—14 of FIG. 12 which shows a bottom plan view, when the vehicle is upright such as in FIG. 11 the wheels 226 and 228** are allowed to rotate clockwise and are inhibited from rotating counterclockwise.

When the lazy tong 202 is contracted as in FIG. 12 and then expanded toward the view shown in FIG. 15, the rear wheels are prevented from rotating counterclockwise. However, as the lazy tong 202 expands, the front wheels are allowed to rotate clockwise. The vehicle thus pushes against the fixed rear wheels 228 and as the lazy tong 202 expands, it rides on the rotating front wheels 226. When expansion is complete and the lazy tong 202 starts to contract, this contraction pulls against the front wheels 226 causing them to want to rotate counterclockwise, which is prevented because of the ratchet mechanism. The rear wheels however, are being pulled, and thus are urged to rotate clockwise, which they are allowed to do. This allows the lazy tong mechanism 202 to contract against the fixed front wheels 226 while the rear wheels 228 rotate as they are pulled towards the front wheels 226. As can be seen, the lazy tong vehicle 174 therefore moves by pushing against the rear wheels 228 which are first engaged against the support surface as the lazy tong mechanism 202 expands and then pulls against the front wheels 226 which are fixed against rotation as the lazy tong mechanism 202 contracts.

Referring now to FIGS. 16 through 19, a second embodiment of the toy vehicle of the invention is illustrated. In this embodiment of the invention the toy arc walking vehicle 236 is shown. This vehicle uses the fluid engine 40 previously described. Furthermore, it uses identical charging valves 180, relief valves 182 and fluid line 184 previously described for the lazy tong vehicle 174.

A reservoir 238 is mounted on the base 240. A front rocker support 242 and a rear rocker support 244 are mounted to the base 240 via split axles 246 and 248 respectively. Each of the rocker supports 242 and 244 have a rearwardly extending extensions 250 and 252, respectively, integrally formed as a part of them. A connecting link 254 pivotally connects between the extensions 250 and 252. Movement of one of the rocker supports 242 or 244 is therefore transferred to an identical movement of the other rocker support 242 or 244. Each of the rocker supports 242 and 244 are identical and therefore further description with regard to details of one apply to the other and like numerals will be utilized in describing these. A front transverse member 256 extends across both rocker supports 242 and 244. The front transverse members 256 are just slightly wider than the width of the rocker supports 242 and 244 at the point where they are mounted on the axles 246 and 248. A rear transverse member 258 extends across both of the rocker supports 242 and 244 behind the front transverse member 256. The rear transverse member 258 is wider than the front transverse member 256. An axle 260 extends within both of the front transverse member 256 and axle 262 extends within both of the rear transverse members 258.

A plurality of identically sized and shaped motion members, divided into and collectively identified in two different groups by the numerals 264 and 266 are mounted on the respective ends of the axles 260 and 262. Two motion members 264 are thus located on the ends of axles 260 on both the front transverse member 266 and the rear transverse member 258 and two motion members 266 are located on the ends of axle 262 on both the front transverse member 256 and the rear transverse member 258. In total, therefore, there are four motion members 264 and four motion members 266.

Figure 16:
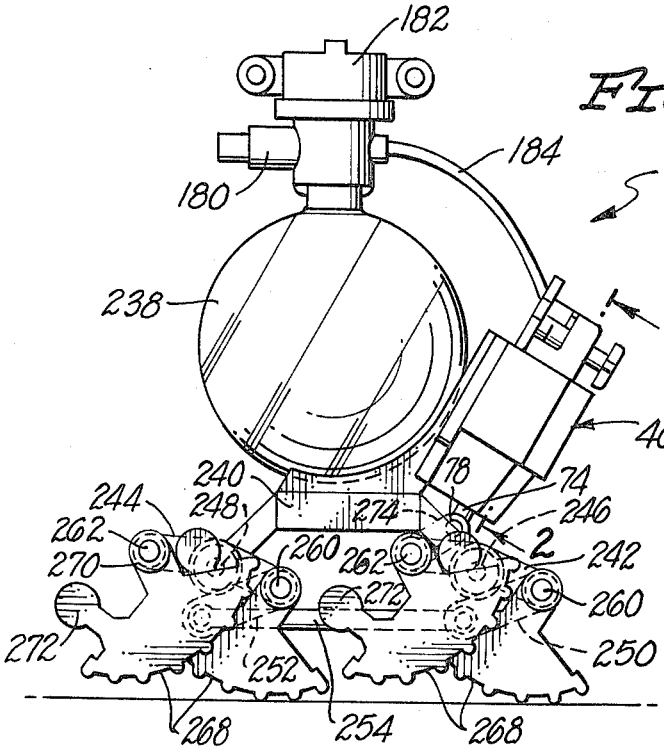
FIG. 16 is a side elevational view of an alternate embodiment of a vehicle of the invention.
Figure 17:
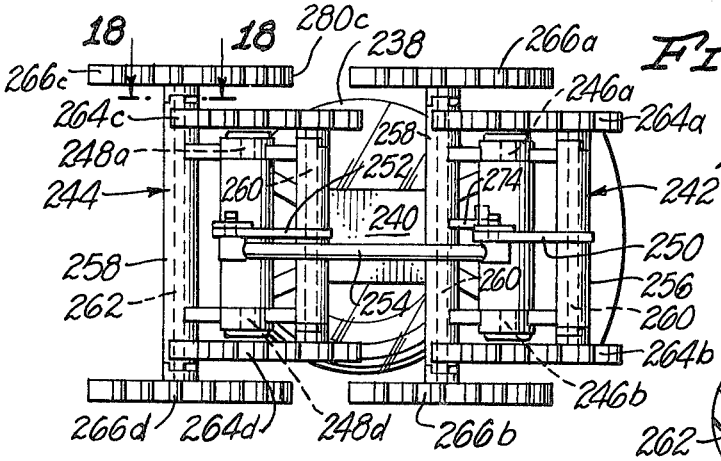
FIG. 17 is a bottom plan view of the embodiment seen in FIG. 16.
Figure 19:
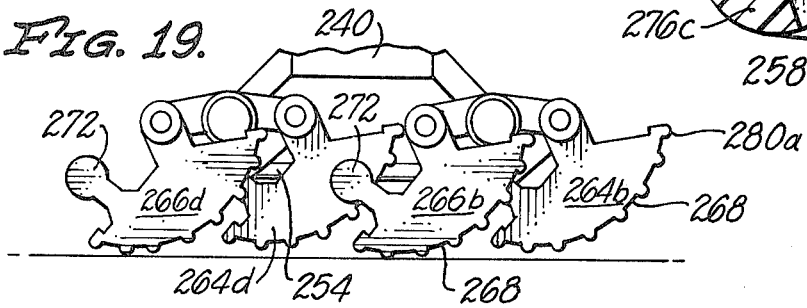
FIG. 19 is a side elevational view of the bottom portion of FIG. 16 showing certain components in a different spatial relationship than as seen in FIG. 16.

Each of the motion members 264 and 266 have an arcuate surface collectively identified by the numeral 268. Each of the motion members 264 and 266 have a bearing 270 by which they are mounted to their respective axles 260 and 262. The center of rotation of the bearings 270 are displaced from the center of rotation of the arcuate surfaces 268. A tab, collectively identified by the numeral 272 is also located on each of the motion members 264 and 266. This tab is placed on the side of the bearing 270 wherein the center of rotation of the arcuate surfaces 268 is located. Because of the presence of the tab 272 which, in fact, contributes mass, and the placement of the bearings 270 off-center from the center of rotation of the arcuate surfaces 268, the motion members 268 and 266 as seen in FIGS. 16 and 19, if they are suspended only by the bearings 270 and are not in contact with any support surface will tend to rotate counterclockwise because of the location of their center of gravity to the left of the location of their pivot point about bearing 270.

If, however, the arcuate surfaces 268 of the motion members 264 and 266 are in contact with the support surface and weight is applied to the motion members 264 and 266 by the weight of the vehicle 236, because the center of rotation about the bearings 270 is displaced to the right of the center of rotation of the arcuate surfaces 266, the motion members 264 and 266 will tend to rotate clockwise. Thus in FIG. 16, the motion members **264*a* and 264*c* in contact with the support surface are being rotated clockwise by the weight of the vehicle 236 wherein motion members 266*a* and 266*c* are being rotated counterclockwise because their center of gravity is displaced to the left from their center of rotation about bearing 270. If the position of the members 264 and 266 is reversed such that the members 266 contact the support surface and the members 264 are suspended above the contact surface, their rotation reverses, that is, the members 266 now rotate clockwise whereas the members 264 rotate counterclockwise. It is thus evident that by alternately contacting and then lifting the members 264 or 266 they will rotate counterclockwise and then clockwise. By shifting the weight of the vehicle 236 back and forth between the group of members represented by the numerals 264 and 266, vehicle 236 can be made to walk on the arcuate surfaces 268 of its motion members 264 and 266**.

As the piston member 74 of the fluid engine 40 moves up and down, it can transfer motion to rocker support 242 via an extension 274 formed as a part of front rocker support 242. The extension 274 is fixedly formed with the front rocker support 242 and can be pivotally attached via the boss 78 to the piston member 74. As noted before, movement of the front rocker support 242 is communicated to the rear rocker support 244 via the connecting link 254. The up and down movement then of the piston member 74 then can cause alternate rocking of the front rocker and rear rocker supports 242 and 244 respectively which cause alternate engagement of the two groups of motion members 264 and 266 with the support surface allowing for movement of the vehicle on the arcuate surfaces 268 on each of these support members in a forward direction.

Figure 18:
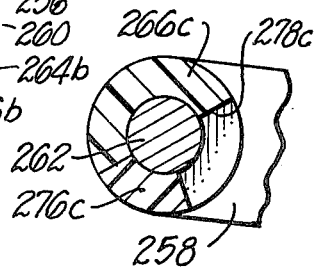
FIG. 18 is a side elevational view in section about the line 18—18 of FIG. 17.

In FIG. 18, mounting of a motion member **266*c* is depicted. All of the other motion members are likewise mounted. A stop 276*c* is formed on the rear transfer member 258. A hemispherical stop 278*c* is likewise formed in the inside of the motion member 266*c*. The stop 278*c* limits the arcuate travel of the motion member 266*c* about the axle 262 such that the motion member 266*c* is not completely rotated past the front leading edge 280*c* on the motion member 266*c*. In FIG. 19, the front leading edge 280*a*** is identified for better viewing of its position.

Referring now to FIGS. 20 through 23, a hopping vehicle 282 is illustrated. As with the other embodiments previously illustrated certain of the components of the vehicle 282 are equivalent to components previously described and as such identical numerals will be utilized. The vehicle 282 utilizes the fluid engine 108 as illustrated in FIGS. 6 through 10 previously described. The fluid engine 108 is seen attached to the front of the hopping vehicle 282. The activation member 166 can be seen projecting downwardly below the fluid engine 108 in FIG. 20. As with the other embodiments, the vehicle 282 utilizes a check valve 180, a pressure relief valve 182 and a fluid inlet line 184 in conjunction with a fluid reservoir 284. The fluid reservoir 284 differs from fluid reservoirs 178 and 238 only in its outside shape.

The vehicle 282 includes a base 286. The reservoir 284 and the fluid engine 108 are appropriately mounted to the base 286. The activation button 166 extends downwardly from the base and is pivotally mounted to the base 286 via axle 168. Piston member 114 couples to axle 120 as can be seen in FIG. 21. Axle 120 is formed as a part of front appendage member 288. The member 288 is a complex shaped member having right front leg 290 formed as a part thereof, left front leg 292 formed as a part thereof and extension 294 also formed as a part thereof. The axle 120 connects to the extension 294 and transfers the motion of the piston member 114 to the entirety of the front appendage member 288.

Front appendage member 288 is pivotally mounted to the base 286 via axle 296 which extends across the width of the base 286 and pivotally mounts the member 288 to both sides of the base 286. As a mechanical component the front appendage member 288 is a first class lever being pivoted about the axle 296. Extending backwardly and formed as an integral part of the member 288 are the right side extension 298 and the left side extension 300. In response to downward movement of the piston member 114 the totality of the front appendage member 288 pivots about axle 296. In so pivoting the right and left side legs 290 and 292 move downwardly while the right and left side extensions 298 and 300 move upwardly.

The vehicle 282 includes a right rear appendage 302 and a left rear appendage 304. Both of these appendages are complex members. Except for symmetry, the right and left rear appendages are identical. The component parts of each therefore will be identified with the same set of numbers, followed by the alphabetical notation "a" for the right and "b" for the left where appropriate. Each of the right and left rear appendages 302 and 304 include a lower link 306 and a first upper link 308 and a second upper link 310. First upper link 308 is pivotally attached to the lower link 306 via a pivot pin 312 and second upper link 310 is pivotally attached to lower link 306 via a pivot pin 314.

Both the right and left first upper links 308*a* and 308*b* are pivotally attached to the base 286 via an axle 316 which passes through appropriate holes in the base and has the respective link attached at its ends. The lower links 308 therefore pivot with respect to the base about the center of the axle 316. The upper links 310*a* and 310*b* respectively are pivotally mounted to the right and left rear appendages 302 and 304 of the front appendage member 288 via pins 318 and 320.

A right side linking member 322 is pivotally mounted about axle 316. Likewise, a left side linking member 324 is pivotally mounted about axle 316. The other end of the right side link 322 is pivotally attached to the second upper link 310*a* about the end of an axle 326. Likewise, the left side link 324 is pivotally attached to the left side upper link 310*b* via the other end of the axle 326. The axle 326 extends across the upper surface of the base 286 below the reservoir 284 and is slidable with respect to the upper surface of the base 286. By having the axle 326 continuous between the two second upper links 310*a* and 310*b* simultaneous motion of these two links is assisted.

A wheel 328*a* is appropriately mounted on the lower end of the lower link 306*a* and a wheel 328*b* is appropriately mounted on the lower end of the lower link 306*b* by appropriate screws collectively identified by the numeral 330. While the wheels 328*a* and 328*b* are free to turn about the lower links 306*a* and 306*b* their rotation is not free wheeling, and some friction exists between wheels 328*a* and 328*b* and the lower links 306 inhibiting rotation to a certain extent. Each of the wheels 328*a* and 328*b* includes a rubber ring 332*a* and *b* mounted around them for gripping a support surface. In use, the wheels 328 of the vehicle 282 do not roll on the surface but simply provide for a gripping point against that surface via the interaction of the rubber rings 332*a* and *b*. Some rotation of the lower links 306*a* and *b* occurs about the screws 330 as the lower links 306*a* and *b* move. This is restricted rotation however, and only through a limited number of degrees.

A contact member 334 is located on the respective ends of the right and left front legs 290 and 292. In the drawings only the one, 334*a*, on the right front leg 290 is shown, the one on the left front legs being identical in shape and size. Two extensions 336*a* and 336*b* are formed as an integral part of the base 286 and extend to the right and left side of the hopping vehicle 282. These extensions 336*a* and *b* are primarily cosmetic in nature; however they can serve to maintain the vehicle 282 in an upright position should the vehicle list to the right or left for some reason.

Figure 20:
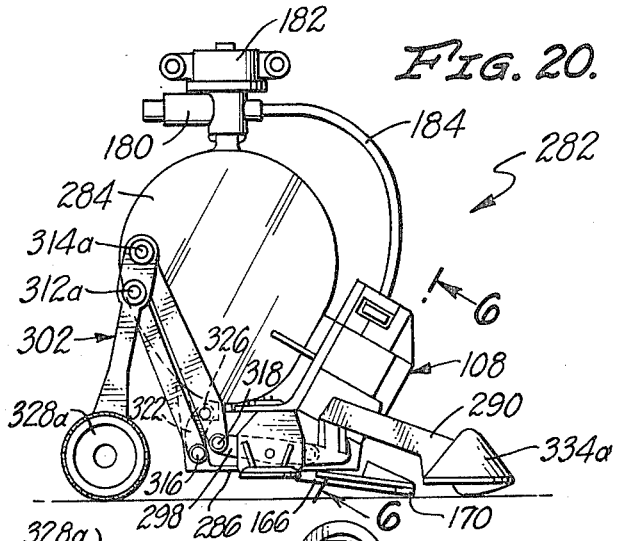
FIG. 20 is a side elevational view of an alternate embodiment of a toy vehicle of the invention.

The hopping vehicle 282 works as follows. When it is in the conformation as seen in FIG. 20 it is supported in the rear by the wheels 328 and in the front by the contact members 334. When so supported, the end 170 of the activation member 166 is in contact with the support surface and the contact of the activation member 166 with the support surface biases the slide member 154 upwardly, which in turn urges bell crank 146 counterclockwise to allow for charging of the cylinder 110 of the fluid engine 108 with pressurized air. This activates the engine 108 propelling the piston member 114 downwardly. As the piston member 114 is propelled downwardly, it acts via the extension 294 to rotate the front appendage member 288 about the axle 296. This forces the front legs 290 and 292 downwardly and concurrently through the linkage of the extensions 298 and 300 interacting with the second upper links 310*a* and 310*b* forces the composite rear appendages 302 and 304 to flex such that the first and second upper links 308*a* and *b* and 310*a* and *b* move from a position where they form an acute angle with respect to the lower links 306*a* and *b* to a position where they form an obtuse angle with the links 306*a* and *b*. This motion is seen when moving from FIG. 20 to FIG. 22.

The first and second upper links 308 and 310 together with the links 322 or 324 and the upper portion of the lower links 306*a* and *b* form parallelograms which are pivoted about the pivot points centered about axles 316 and 326 and pins 312 and 314. The downward movement of the front legs 290 and 292 as well as the movement of the links 308 and 310 with respect to the links 306 moves the base 286 and all of the components attached thereto of the vehicle 282 upwardly and forwardly. This upward and forward movement can be viewed by comparing the position of the reservoir 284 with the wheels 328 in FIGS. 20 and 22. In any event, the vehicle 282 moves upwardly and forwardly in a hopping motion.

This upward and forward motion of the vehicle 282 conincides with the downward movement of the piston 112 in the cylinder 110 in the fluid engine 108. When the piston 112 reaches its lower limit of travel, the interaction of the boss 116 with the bell crank 126 flips the toggle joint composed of link 142 and arm 148 of the bell crank 146 such that the spring 150 biases the bell crank 146 clockwise which in turn slides the valve rod 72 inwardly into the valve 50, stopping the introduction of the pressurized fluid into the cylinder 110 and opening the exhaust port within the valve 50. With the loss of pressurized fluid in the cylinder 110, the piston 112 under the bias of the spring 136 interacting through the piston member 114 moves upwardly and in doing so allows the piston member 114 to also move upwardly. This motion is transferred to the front appendage member 288 and to the rear appendages 302 and 304 ultimately connected thereto.

After reaching its maximum upward trajectory, the vehicle 286 descends because it will not be supported in an extended orientation by the right and left front legs 290 and 292 and the rear appendages 302 and 304. The valve 50 however, remains in the exhaust position. When the hopping vehicle 286 sinks into the orientation approaching that seen in FIG. 20 the activation member 166 contacts the support surface and upon complete slumping of the vehicle 282 into the position seen in FIG. 20 the activation button 166 is pushed upwardly, causing the slide member 154 to move with in the fluid engine 108 which in turn rotates the bell crank 146 shifting the valve 50 from the exhaust mode to the charging mode to once again fill the cylinder 110 causing the vehicle 282 to once again hop.

The movement of the piston 112 in the cylinder 110 is quite forceful. The oversizing of the piston 112 in the engine 108 compared to the piston 52 in the engine 40 results in this force. This is sufficient to thrust the vehicle 282 forwardly and upwardly to cause it to hop along the surface. The presence of the rubber rings 332 and the restricted rotation of the wheels 328 prevent the vehicle from moving backwardly by ritation of the wheels 328 as it descends.

Figure 22:
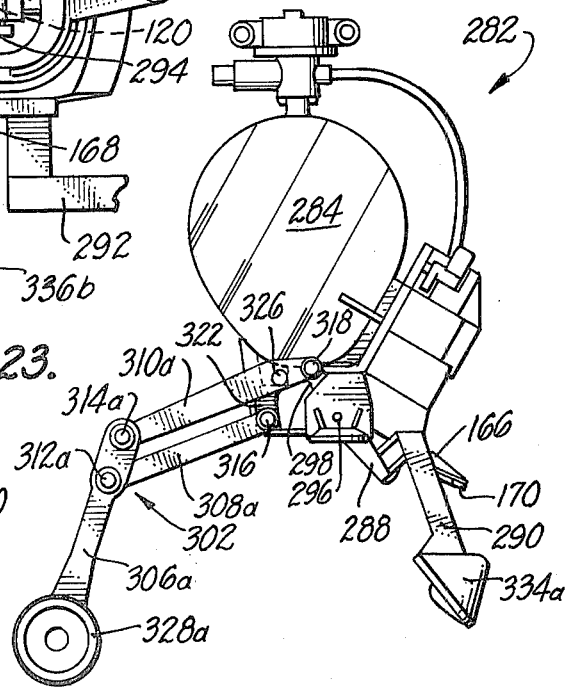
FIG. 22 is a side elevational view of the embodiment of FIG. 20 with certain components of this embodiment shown in a different spatial relationship than is seen in FIG. 20.
Figure 23:
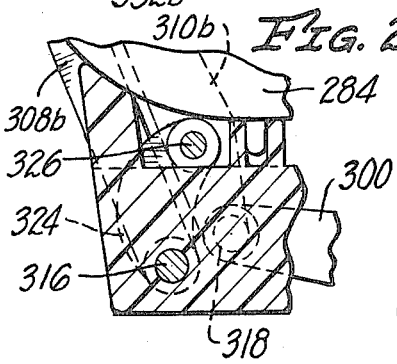
FIG. 23 is a side elevational view in partial section about the line 23—23 of FIG. 21.

Because of the orientation of the linkage between the front appendage member 288 and the rear appendages 302 and 304 the distance between the contact member 334 on the right hand side and the wheel **328*a* on the right hand side of vehicle 282 as well as their corresponding members on the left hand side of vehicle 282 remain essentially constant in moving from the orientation seen in FIG. 20 to that seen in FIG. 22. The thrust of the fluid engine 108 is thus not wasted in sliding the appropriate ends of the front and rear appendages with respect to one another but is solely directed to an upward and foreward movement of the vehicle 282**.

We claim:

1. A propulsion device comprising:

a housing;

a cylinder located in association with said housing;

a means associated with said housing for supplying pressurized fluid to said cylinder;

a valve means associated with said cylinder, said valve means having an exhaust port means connecting between the interior of said cylinder and the ambient environment, said valve means having a supply port means connecting between the interior of said cylinder and said means for supplying said fluid, said valve means having a charging position wherein pressurized fluid from said means for supplying pressurized fluid is introduced into the interior of said cylinder and an exhaust position wherein fluid from within the interior of said cylinder is exhausted to the ambient environment;

a piston located in the interior of said cylinder, said piston capable of moving in a power stroke in response to said valve means being in said charging position and pressurized fluid being introduced into the interior of said cylinder, said piston capable of moving in an exhaust stroke in response to said valve means being in said exhaust position;

a piston member operatively associated with said piston and extending out of said cylinder, said piston member capable of moving linearly in a first direction as said piston moves in said power stroke and linearly in a second direction as said piston moves in said exhaust stroke;

a connecting means operatively connecting said piston member and said valve means, said connecting means including at least a toggle joint, a first biasing element and a bell crank having two arms;

said toggle joint comprising a first and second elongated element each having ends and joined together at one of the ends of each of said first and said second element, said toggle joint located on said housing in association with both said valve means and said piston member and having one of said first and said second elongated elements operatively connected to said valve means and the other of said first and said second elongated elements operatively connected to said bell crank, said elements of said toggle joint capable of being located with respect to one another in a right hand side over-center toggle orientation and a left hand side over-center toggle orientation with respect to one another, said valve means being in said charging position when said elements of said toggle joint are in one of said right hand side or said left hand side over-center toggle orientations and said valve means being in said exhaust position when said elements of said toggle joint are in the other of said right hand side or said left hand side over-center toggle orientations, said valve means moving between said charging and said exhaust positions in response to said elements of said toggle joint moving between said right hand side and said left hand side over-center toggle orientations;

said first biasing element associated with at least one of said first or said second elements of said toggle joint, said first biasing element capable of maintaining said first and said second elements of said toggle joint in both said right hand side and said left hand side over-center toggle orientations;

said bell crank pivotally mounted on said housing, the end of one of the arms of said bell crank operatively connecting to the other of said ends of said second element of said toggle joint, the other of said arms of said bell crank operatively connecting to said piston member.

2. The propulsion device of claim 1 wherein:

said first biasing element connects between the other of the ends of said first and said second elements of said toggle joint.

3. The propulsion device of claim 1 including:

a second biasing element operatively associated with said housing and one of said bell crank or said piston member, said second biasing element biasing said one of said bell crank or said piston member which in turn biases the other of said bell crank or said piston member such that said piston member is biased in said second direction in response to piston movement in said exhaust stroke.

4. The propulsion device of claim 1 wherein:

said valve means includes control rod means, said control rod means operatively associated with said first element of said toggle joint and moving in response to movement of first element of said toggle joint.

5. The propulsion device of claim 4 wherein:

said valve means includes a valve body having an inlet port, an exhaust port and a cylinder port, said exhaust port opening to the ambient environment, said inlet port connecting to said means for supplying pressurized fluid, said cylinder port connecting to said cylinder;

a movable valve element located within said valve body and capable of alternately sealing one of said exhaust port or said inlet port, said movable valve element associated with said control rod means and movable within said valve body such that when said elements of said toggle joint are in one of said right hand side or said left hand side over-center toggle orientation said movable valve element seals one of said exhaust port or said inlet port to fluid movement through said port and when said elements of said toggle joint are in the other of said right hand side or said left hand side over-center toggle orientations said movable valve element seals the other of said exhaust port or said inlet port.

6. The propulsion device of claim 5 including:

a second biasing element connects between said housing and the end of said arm of said bell crank pivotally attaching to said piston member.

7. The propulsion device of claim 6 wherein:

said bell crank is operatively associated with said second element of said toggle joint and said transfer member is operatively associated with said first element of said toggle joint.

8. The propulsion device of claim 7 including:

said second biasing element operatively associated with said housing and said piston member, said second biasing element biasing said piston member which in turn biases said bell crank.

9. The propulsion device of claim 1 including:

a transfer member, said transfer member operatively associated with said toggle joint;

a control means movably associated with said housing and operatively associated with said transfer member;

said elements of said toggle joint moving from one of said right hand side over-center orientation to said left hand side over-center orientation or from said left hand side over-center toggle orientation to said right hand side over center toggle orientation in response to movement imparted to said elements of said toggle joint by one of said bell crank or said transfer members and moving from the other said right hand side over-center toggle orientation to said left hand side over-center toggle orientation or from said left hand side over-center toggle orientation to said right hand side over center toggle orientation in response to movement imparted to said elements of said toggle joint by the other of said bell crank or transfer members.

10. The propulsion device of claim 1 wherein:

said first element of said toggle joint comprises one of two arms of a second bell crank, said second bell crank pivotally mounted on said housing in association with said second element of said toggle joint.

11. The propulsion device of claim 10 wherein:

said transfer member is operatively associated with the other of the arms of said second bell crank.

12. The propulsion device of claim 11 wherein:

said valve means includes control rod means, said control rod means operatively associated with said first element of said toggle joint and moving in response to movement of said first element of said toggle joint;

said valve means includes a valve body having an inlet port, an exhaust port and a cylinder port said exhaust port opening to the ambient environment, said inlet port connecting to said means for supplying pressurized fluid, said cylinder port connecting to said cylinder;

a movable valve element located within said valve body and capable of alternately sealing one of said exhaust port or said inlet port, said movable valve element associated with said control rod means and movable within said valve body such that when said elements of said toggle joint are in one of said right hand side or left hand side over-center toggle orientations said movable valve elements seals one of said exhaust port or said inlet port to fluid movement through said port and when said elements of said toggle joint are in the other of said right hand side or said left hand side over-center toggle orientations said movable valve elements seal the other of said exhaust port or said inlet port.

* * * * *

UNITED STATES PATENT AND TRADEMARK OFFICE

CERTIFICATE OF CORRECTION

PATENT NO. : 4,472,996

DATED : September 25, 1984

INVENTOR(S) : Masami Furukawa; Kenzo Akiyama

It is certified that error appears in the above-identified patent and that said Letters Patent is hereby corrected as shown below:

Column 4, line 46 "sufface" should read --surface--.

Column 7, line 13 "moved" should read --moves--.

Column 8, line 41 "decsribed" should read --described--.

Column 8, line 54 "illustrate" should read --illustrates--.

Column 11, line 27 "200" should read --100--.

Column 13, line 65 "46" should read --146--.

Column 14, line 64 "142" should read --112--.

Column 16, line 12 "link" should read --linking--.

Column 17, line 45 "member" should read--members--.

Column 18, line 4 "268" should read --264--.

Column 18, line 16 "266" should read --268--.

Column 18, line 44 delete "then".

Column 21, line 4 "conincides" should read --coincides--.

Column 21, line 31 "with in" should read--within--.

Column 21, line 43 "ritation" should read --rotation--.

Signed and Sealed this

*Eighteenth* Day of *June 1985*

[SEAL]

*Attest:*

DONALD J. QUIGG

*Attesting Officer* *Acting Commissioner of Patents and Trademarks*